US008430176B2

(12) United States Patent
Xu

(10) Patent No.: US 8,430,176 B2
(45) Date of Patent: Apr. 30, 2013

(54) ZERO BACKLASH DOWNHOLE SETTING TOOL AND METHOD

(75) Inventor: Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 735 days.

(21) Appl. No.: 12/545,418

(22) Filed: Aug. 21, 2009

(65) Prior Publication Data

US 2011/0042104 A1 Feb. 24, 2011

(51) Int. Cl.
*E21B 23/00* (2006.01)
*E21B 23/02* (2006.01)

(52) U.S. Cl.
USPC ..... 166/381; 166/382

(58) Field of Classification Search ..... 166/378, 166/381, 382
See application file for complete search history.

(56) References Cited

U.S. PATENT DOCUMENTS

| | | | | |
|---|---|---|---|---|
| 4,516,634 | A * | 5/1985 | Pitts | 166/120 |
| 6,715,560 | B2 * | 4/2004 | Doane et al. | 166/387 |
| 8,109,339 | B2 * | 2/2012 | Xu | 166/382 |
| 2009/0065217 | A1 * | 3/2009 | Ross | 166/373 |
| 2010/0294514 | A1 * | 11/2010 | Crow et al. | 166/386 |

OTHER PUBLICATIONS

Zbitowsky, R., et al. Pressure Transient Analysis Data Collected by the Use of a Retrievable Gauge Hanger in Saudi Arabian Gas Wells, SPE 113589, Society of Petroleum Engineers, Presentation at the 2008/ICoTA Coiled Tubing and Well Intervention Conference and Exhibition, The Woodlands, TX, Apr. 1-2, 2008, pp. 1-8.

* cited by examiner

*Primary Examiner* — Daniel P Stephenson
(74) *Attorney, Agent, or Firm* — Cantor Colburn LLP

(57) ABSTRACT

A zero backlash downhole setting tool includes a mandrel having a number of recesses therein. A subassembly having a number of fingers is at least partially receivable in the recesses. The subassembly is in force transmissive communication with a device to be set. A lock wedge is in radially deflecting communication with the fingers and a setting sleeve is in operable communication with the device to be set and the lock wedge. Also included is a method for setting a device with zero backlash.

25 Claims, 3 Drawing Sheets

ZERO BACKLASH DOWNHOLE SETTING TOOL AND METHOD

BACKGROUND

Common in the downhole drilling and completion arts is the traditional body lock ring. The ring is well known and includes a finely threaded section commonly referred to as "wicker threads" or "wickers" on an inside dimension of the body lock ring that are configured to be engageable with a set of wickers on an outside dimension surface of another component. The body lock ring may be urged along the other component under an applied force to ratchet into a final set position. Because there is a finite distance between adjacent peaks of wicker threads, there is necessarily a potential backlash. In the event that the applied force brings the wickers to very close but not quite the next wicker trough, the device being actuated will relax in backlash by the distance between the wickers. It is possible to reduce backlash by reducing the peak-to-peak distance between adjacent wickers. A reduction in this dimension, however, is often accompanied by a reduction in every tooth dimension including height and flank surface area as well. A reduction in tooth flank surface area tends to proportionally reduce the "holding ability" of such flanks. While the backlash is necessarily reduced in this type of construction, the potential for slippage of the body lock so constructed is increased. Since slippage is unquestionably undesirable, wickers with reduced peak-to-peak dimensions are not often the selected solution to the backlash problem.

In some situations the backlash is inconsequential while in others it can be catastrophic to the function of the particular tool or device. For example, if the device is a sealing tool, the backlash may allow sufficient energy in the seal to relax that the seal function is substantially lost. In other devices, while the entire or any substantial part of the functionality may not be lost, it clearly would be better for the ring to retain the input energy than to lose energy. Hence, it is axiomatic that the art would well receive improved apparatus where backlash is reduced or eliminated.

SUMMARY

A zero backlash downhole setting tool including a mandrel having a number of recesses therein; a subassembly having a number of fingers at least partially receivable in the recesses, the subassembly in force transmissive communication with a device to be set; a lock wedge in radially deflecting communication with the fingers; and a setting sleeve in operable communication with the device to be set and the lock wedge.

A method for setting a device with zero backlash including running the zero backlash downhole setting tool including a mandrel having a number of recesses therein; a subassembly having a number of fingers at least partially receivable in the recesses, the subassembly in force transmissive communication with a device to be set; a lock wedge in radially deflecting communication with the fingers; and a setting sleeve in operable communication with the device to be set and the lock wedge into a borehole with a device to be set; urging a setting sleeve in a direction to set the device; moving a lock wedge with the setting sleeve into contact with the fingers; and deflecting the fingers into the recesses.

BRIEF DESCRIPTION OF THE DRAWINGS

Referring now to the drawings wherein like elements are numbered alike in the several Figures.

DETAILED DESCRIPTION

Figure 1:
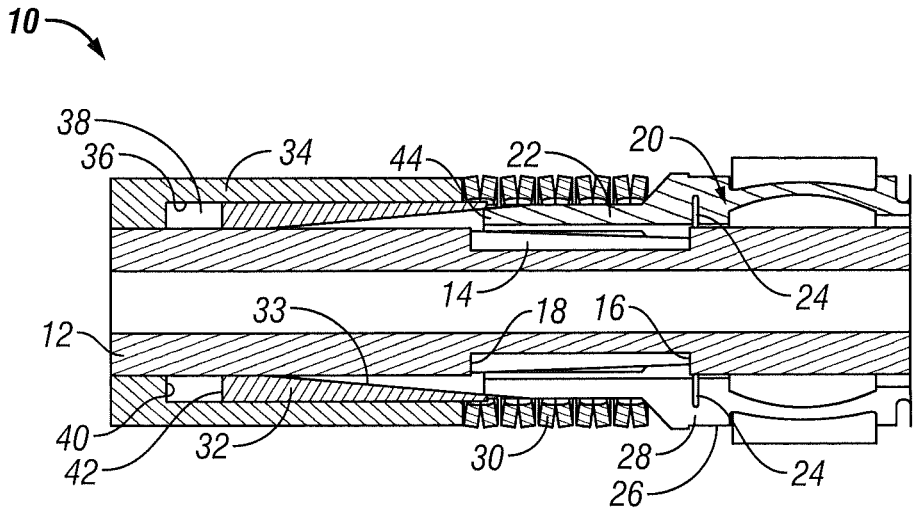
FIG. 1 is a schematic cross sectional view of a zero backlash downhole setting tool in an unset position.
Figure 3:
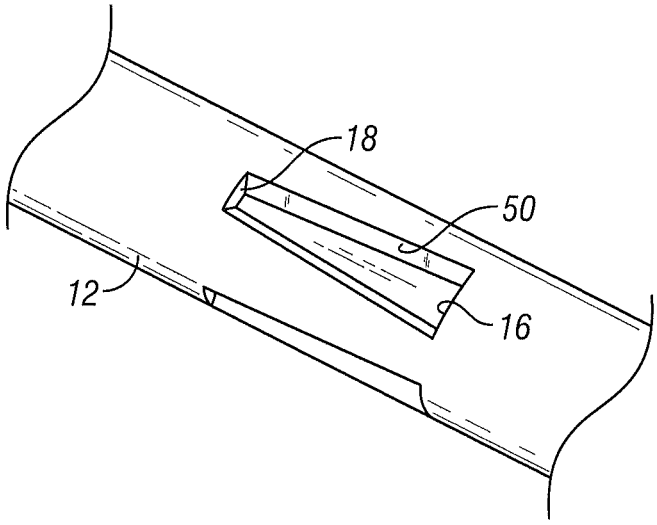
FIG. 3 is a perspective view of a mandrel upon which other components of the downhole setting tool mount, and that is configured to receive the fingers illustrated in FIG. 2.

Referring to FIG. 1, a zero backlash downhole setting tool 10 includes a mandrel 12 having a number of recesses 14 therein. The recesses are illustrated in the Figures hereof as four in number but it is to be understood that other numbers of recesses 14 are also employable. Each recess 14 includes two ends 16 and 18 (see also FIG. 3). Ends 16 are larger cross sectionally than ends 18. More specifically, and addressing the shape actually illustrated (but recognizing that the specific shape is not intended to be construed as limiting), the cross section of end 16 is in the shape of a trapezoid. End 18 is also in the shape of a trapezoid but the area defined by the trapezoid at 16 is greater than the area defined by the trapezoid at 18. In one embodiment each side of trapezoids at end 16 are larger than each side of the trapezoids at end 18.

Mounted at the mandrel 12 and still referring to FIG. 1, is a device 20 (such as a seal or any other axial force settable tool) to be set by the downhole setting tool 10. As illustrated the device 20 is a seal but it is to be understood that any device requiring axial compression for setting can be set by the downhole setting tool 10. As illustrated the device 20 is integral with a plurality of fingers 22. The fingers are deflectable radially inwardly at least partially into recesses 14 during use of the downhole setting tool 10. Facilitating flexibility of the fingers 22 in the illustrated embodiment is a flexibility groove 24 extending from an inside dimension surface 26 toward an outside surface 26 without reaching the outside surface 26 creating a living hinge 28. In an alternate embodiment that would illustrate the same as the FIG. 1 embodiment can be configured with the fingers 22 supported not by the device 20 but by their own ring 25 that will be adjacent the position the living hinge 28 occupies in device 20 (see FIG. 2). Such embodiment will be distinct from device 20 at line 27. The alternate subassembly 29 of the fingers will other than in FIG. 2 appear similar to that illustrated since that subassembly will be directly adjacent the device 20.

Still referring to FIG. 1, one or more resilient elements 30 are positioned to be axially compressively loadable during use of the downhole setting tool 10. In one embodiment the resilient elements are a series of spring washers. As illustrated, the spring washers are frustoconical washers. Adjacent the fingers 22 is a lock wedge 32 having a frustoconical inside surface 33 that is moveable into contact with the fingers to maintain a particular selected position of the fingers during use of the device. The surface has an angle alpha of greater than about 0 degrees and about 45 degrees to facilitate self locking of the frustoconical surface with the fingers. In a specific embodiment the angle is about 7 degrees. The angle alpha appropriately selected in accordance herewith can be determined using the formula:

$$\text{alpha}=\arctan(\text{coefficient of friction})$$

Figure 2:
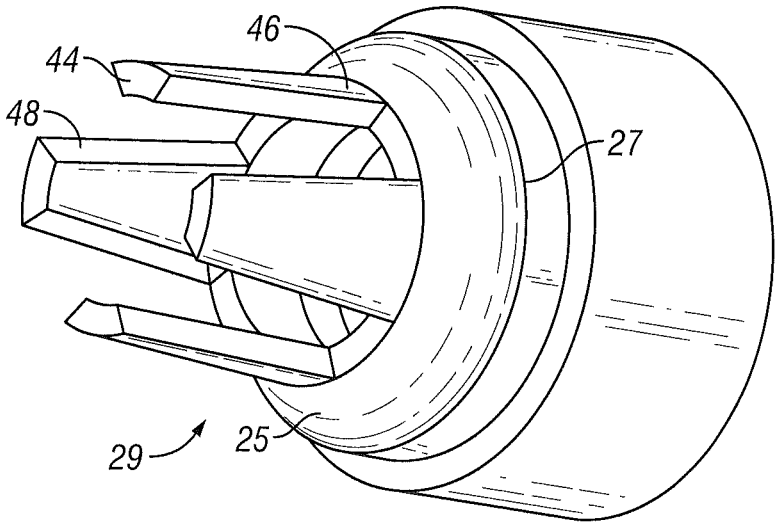
FIG. 2 is a perspective view of the fingers illustrated and identified in FIG. 1.
Figure 5:
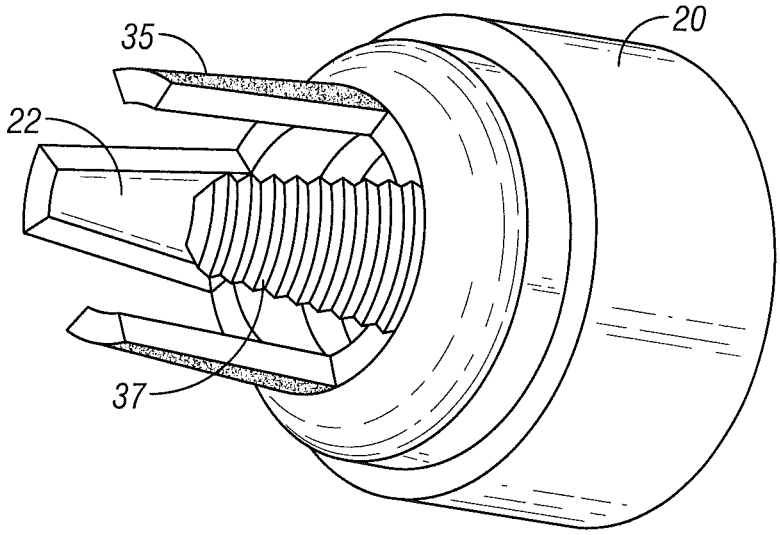
FIG. 5 illustrates alternate surface treatments for the fingers illustrated in FIG. 2.

The embodiment of FIG. 2 illustrates a smooth surface having, accordingly, a relatively low coefficient of friction. In other embodiments, two illustrated in FIG. 5 at numeral 35 and 37, a surface having a greater coefficient of friction is presented enabling different angles. Numeral 37 indicates a wickered (toothed profile) surface that will bite into the frustoconical surface 33 of the lock wedge 32. It should be noted that the surface 33 can be textured similarly, if desired. Further it is noted that each of the fingers 22 may have the same surface texture or may have different surface textures, as desired.

The downhole setting tool 10 further includes a setting sleeve 34 having an inside diameter surface 36 that is large enough to extend over an outside dimension of the lock wedge 32.

In operation, a setting force is applied from somewhere to the left of the drawing in FIG. 1 on setting sleeve 34. The setting force may be from a surface location or other remote location. Upon initial axial load, the force is transmitted to the one or more resilient elements and through those to the device 20. The one or more resilient elements are to be selectively compressed by the action of the setting sleeve 34 primarily so that a significant amount of biasing force remains available in the system post setting. It will be appreciated that the setting sleeve 34 inside dimension surface 36 extends axially farther than the lock wedge does leaving an annular volume 38. The volume 38 functions to ensure that the one or more resilient elements 30 are selectively compressed while the setting sleeve 34 is being set and before making contact with the lock wedge 32. Once the one or more elements 30 are compressed to the selected degree, the degree being related to substantial set of the device 20, setting sleeve 34 closes the volume 38 and causes a contact between sleeve shoulder 40 and lock wedge end 42. Because the one or more resilient members are not fully compressed prior to or even at the contact between sleeve shoulder 40 and lock wedge 42, there is still the possibility of relative movement between the setting sleeve 34 and the finger 22, which relative movement is needed to allow the lock 32 to move toward the device 20 and deflect the finger(s) 22 radially inwardly into contact with the recesses 14.

It is to be understood that the finger(s) 22 deflect at the living hinge 28 and hence do not directly radially inwardly move as a unit but rather tips 44 of the fingers 22 will move more radially inwardly than bases 46, see FIG. 2.

Figure 4:
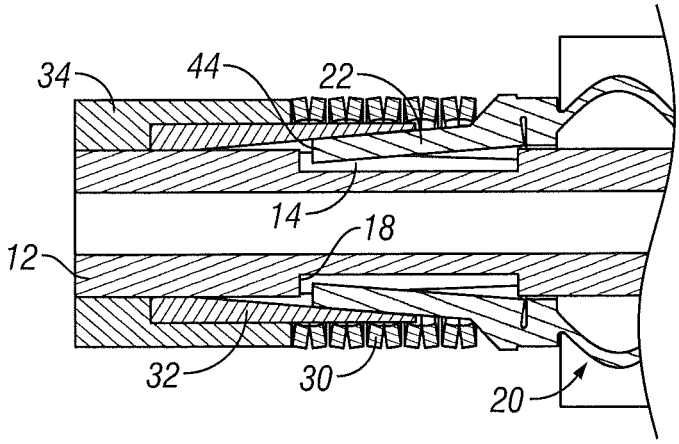
FIG. 4 is an illustration similar to that of FIG. 1 but somewhat magnified and in the set position.

The set position of the downhole setting tool 10 is illustrated in FIG. 4 where the position of the tips 44 of the fingers 22 are shown more deeply received in the recess 14 than the bases 46 of the fingers 22. At this point the particular shape of the recesses 14 and the particular shape of the fingers 22 will be better understood. Because of the trapezoidal shape, or other shapes having similar functionality as conveyed hereunder, walls 48 the fingers 22 will have contact with walls 50 of the recesses 14 no matter what relative axial position the fingers and recesses have. The further the tips 44 are from end 18 the deeper into the recesses 14 the tips 44 will go before wall-to-wall contact is achieved. The closer the tips 44 are to the end 18 of the recesses 14 the shallower the radially movement of the tips 44 needs to be before achieving wall-to-wall contact. Once wall to wall contact is achieved, and the lock wedge is jammed radially outwardly of the fingers 22, the system cannot move and hence the setting force put into the device 20 will be maintained indefinitely. The holding force supplied by the downhole setting tool 10 is frictional between the walls of the fingers and the walls of the recesses. Since there are no peaks such as wickers have, there is no backlash. The downhole setting tool 10 described has no backlash and in addition has the benefit of a compressed spring force acting to hold the device 20 in a set position.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A zero backlash downhole setting tool comprising:

a mandrel having a number of recesses therein, each recess having a longest dimension extending axially along the mandrel and having longitudinally and radially tapered walls;

a subassembly having a number of fingers at least partially receivable in the recesses, the subassembly in force transmissive communication with a device to be set;

a lock wedge in radially deflecting communication with the fingers; and a setting sleeve in operable communication with the device to be set and the lock wedge.

2. A zero backlash downhole setting tool as claimed in claim 1 wherein the recesses are configured to have a larger cross sectional area nearer the device to be set and a smaller cross sectional area farther from the device to be set.

3. A zero backlash downhole setting tool as claimed in claim 1 wherein the recesses are trapezoidally shaped.

4. A zero backlash downhole setting tool as claimed in claim 1 wherein the subassembly is physically connected to the device to be set.

5. A zero backlash downhole setting tool as claimed in claim 1 wherein the number of fingers equals the number of recesses.

6. A zero backlash downhole setting tool as claimed in claim 1 wherein the fingers when deflected into the recesses have wall to wall contact creating a frictional engagement with the recesses.

7. A zero backlash downhole setting tool as claimed in claim 1 wherein the fingers are radially inwardly deflectable.

8. A zero backlash downhole setting tool as claimed in claim 1 wherein the lock wedge is a tubular member having a conical inside surface.

9. A zero backlash downhole setting tool as claimed in claim 8 wherein the conical inside surface is the impetus for deflecting of the fingers.

10. A zero backlash downhole setting tool as claimed in claim 1 wherein the setting sleeve is in operable communication with the device to be set through one or more resilient elements.

11. A zero backlash downhole setting tool as claimed in claim 10 wherein the one or more resilient elements are spring washers.

12. A zero backlash downhole setting tool as claimed in claim 1 wherein the device to be set is a seal.

13. A zero backlash downhole setting tool as claimed in claim 1 wherein the fingers deflect into the recesses to a different degree depending upon where along the recesses the fingers engage the walls of the recesses.

14. A zero backlash downhole setting tool as claimed in claim 1 wherein the lock wedge includes a frustoconical inside surface having an angle.

15. A zero backlash downhole setting tool as claimed in claim 14 wherein the angle of the surface is greater than zero degrees to about 45 degrees relative to an axis of the tool.

16. A zero backlash downhole setting tool as claimed in claim 14 wherein the angle of the surface is at about 7 degrees relative to an axis of the tool.

17. A zero backlash downhole setting tool as claimed in claim 14 wherein the angle of the surface is selected using the formula: alpha =arctan(coefficient of friction) relative to an axis of the tool.

18. A zero backlash downhole setting tool as claimed in claim 14 wherein the surface is textured.

19. A zero backlash downhole setting tool as claimed in claim 1 wherein the lock wedge is movable over the recesses to deflect the fingers radially inwardly into the recesses.

20. A zero backlash downhole setting tool as claimed in claim 1 wherein the setting sleeve extends over an outside dimension of the lock wedge.

21. A method for setting a device with zero backlash comprising:

running the zero backlash downhole setting tool as claimed in claim 1 into a borehole with a device to be set;

urging the setting sleeve in a direction to set the device;

moving the lock wedge with the setting sleeve into contact with the fingers; and deflecting the fingers into the recesses.

22. A method as claimed in claim 21 wherein the deflecting is radially inwardly.

23. A method as claimed in claim 21 wherein the moving the lock wedge includes wedging the lock wedge against the deflected fingers.

24. A method as claimed in claim 21 wherein the method includes loading one or more resilient elements between the setting sleeve and the device to be set.

25. A method as claimed in claim 24 wherein the loading is less than a full load to allow further compression to deflect the fingers with the lock wedge on axial compression.

* * * * *